US006516972B1

(12) United States Patent
Knestout

(10) Patent No.: US 6,516,972 B1
(45) Date of Patent: Feb. 11, 2003

(54) DEVICE FOR REMOVING DRIED CAULKING COMPOUND FROM CAULKING TUBE NOZZLE

(76) Inventor: Thomas M. Knestout, 51 Sleepy Hollow Rd., Annapolis, MD (US) 21401

( * ) Notice: Subject to any disclaimer, the term of this patent is extended or adjusted under 35 U.S.C. 154(b) by 0 days.

(21) Appl. No.: 10/085,133

(22) Filed: Mar. 1, 2002

Related U.S. Application Data

(62) Division of application No. 09/637,059, filed on Aug. 11, 2000, now Pat. No. 6,375,044.

(51) Int. Cl.[7] ..... B67D 3/00

(52) U.S. Cl. ..... 222/151; 222/191; 222/192; 222/326; 222/390; 222/563

(58) Field of Search ..... 222/151, 191, 222/192, 323–327, 390, 563

(56) References Cited

U.S. PATENT DOCUMENTS

| | | | | |
|---|---|---|---|---|
| 2,275,185 A | * | 3/1942 | Shinn, Jr. | 222/151 |
| 3,140,015 A | | 7/1964 | Sherbondy | |
| 3,193,146 A | | 7/1965 | Isriggs et al. | |
| 4,291,597 A | * | 9/1981 | Allen | 81/3.48 |
| 4,485,944 A | | 12/1984 | Eichholz | |
| 4,669,635 A | | 6/1987 | Brookhart | |
| 5,154,327 A | | 10/1992 | Long | |
| 5,220,701 A | | 6/1993 | Creato et al. | |
| 5,295,601 A | | 3/1994 | Bostelman | |
| 5,437,074 A | | 8/1995 | White et al. | |
| 5,632,090 A | | 5/1997 | Smith | |
| 5,894,956 A | | 4/1999 | Keith | |
| 6,035,536 A | | 3/2000 | Dewberry | |
| 6,223,957 B1 | | 5/2001 | Hoppe | |

* cited by examiner

*Primary Examiner*—J. Casimer Jacyna
(74) *Attorney, Agent, or Firm*—Banner & Witcoff, Ltd.

(57) ABSTRACT

A tool for removing dried caulking compound from the nozzle of a caulking tube includes a handle and a generally cylindrical member attached to the handle. The generally cylindrical member has a threaded portion, e.g., similar to a wood screw, which is adapted to threadably engage dried caulking compound disposed within the nozzle by rotating the handle. The caulking compound then is removed from the nozzle simply by pulling the tool away from the nozzle. In an alternative embodiment, an elongate member is attached to the handle at one end and a coiled portion at the other end is adapted to threadably engage dried caulking compound disposed within the nozzle.

10 Claims, 3 Drawing Sheets

DEVICE FOR REMOVING DRIED CAULKING COMPOUND FROM CAULKING TUBE NOZZLE

This application is a division of Application Ser. No. 09/637,059, filed Aug. 11, 2000, now U.S. Pat. No. 6,375,044.

FIELD OF THE INVENTION

The present invention is directed to a tool for removing dried caulking compound from a caulking tube nozzle.

BACKGROUND OF THE INVENTION

Caulking compound typically is supplied in disposable, cylindrical cartridges having a discharge nozzle at one end and an internal, slidable plunger. The discharge nozzle typically is constructed from a sturdy plastic material. The caulking compound generally is discharged from the cartridge by a dispenser having a receptacle, contoured to the cartridge configuration, and opposing end walls between which the cartridge is confined. The rear end wall typically receives a drive screw having a handle on one end and a pressure plate on the opposing end which engages the cartridge plunger. By rotating the drive screw, the pressure plate can be advanced into or retracted from the cartridge. Movement of the plunger toward the nozzle compresses the caulking compound until it extrudes through the nozzle.

Cartridges often have a protective foil backing positioned between the cartridge cylinder and the caulking tube nozzle. As illustrated in FIG. 7, some caulk dispensers 50 are equipped with a steel puncture probe 55 pivotably attached to the dispensing end. In the extended position (as shown in FIG. 7), the steel puncture probe 55 can be used to pierce the foil backing of the cartridge, thereby permitting fresh caulk to be dispensed. When not in use, the steel puncture probe 55 can be pivoted underneath the body of the dispenser 50.

Oftentimes a project does not require the use of an entire tube of caulk. After the partial use of a caulk tube, some caulking compound invariably remains in the nozzle portion. During storage of the partially-used caulking tube, the caulking compound within the nozzle portion typically dries and clogs the nozzle. When re-use of the tube is attempted, the dried caulking compound in the nozzle portion inhibits the discharge of caulking compound from the tube. As the pressure plate of the dispenser compresses the caulking compound, the pressure inside the tube increases. When the pressure becomes too great, the tube can rupture (sometimes referred to as "blow-out") and no longer can be re-used.

One approach to re-using caulking tubes has been to cut off an extended portion of the tip of the nozzle which has been clogged by dried caulking compound. This approach suffers from several drawbacks. A significant drawback is that the control of caulk flow is deleteriously affected because the diameter of the nozzle tip is widened.

Another approach has been to use steel puncture probe 55 of a dispenser 50 so-equipped to pierce through dried caulking in the nozzle. This approach also is unsatisfactory. One significant drawback is that the dried caulk merely is displaced without being removed from the caulking tube nozzle. The displaced dried caulk in effect reduces the inner diameter of the caulking tube nozzle, which can impede the control of caulk flow. The displaced dried caulk also can become liberated by the flow of fresh caulk and again restrict flow through the caulking tube nozzle.

It would be desirable to develop an efficient and cost-effective tool to simplify the reuse of caulking tubes. It especially would be desirable to develop a device for removing dried caulking compound from a caulking tube nozzle without adversely affecting subsequent dispensation of the caulking compound.

BRIEF SUMMARY OF THE INVENTION

The present invention is directed to a tool for removing dried caulking compound from the nozzle of a caulking tube. In accordance with a preferred embodiment of the invention, the device comprises a handle and a generally cylindrical member having a first end portion attached to the handle, a middle portion, and a second end generally opposite to the handle. The generally cylindrical member includes a generally threaded portion extending from its second end toward the middle portion. The threaded portion threadably engages dried caulking compound within a caulking tube nozzle by rotating the handle. The dried caulking compound then can be removed from the nozzle simply by pulling the tool away from the nozzle.

In accordance with an alternative embodiment of the invention, a device for removing dried caulking compound from a caulking tube nozzle comprises a handle and an elongate member having a first end portion attached to the handle and a second end generally opposite to the handle. The elongate member comprises a generally coiled portion extending from the second end toward the handle. The generally coiled portion engages dried caulking compound within a caulking tube nozzle by rotating the handle. The dried caulking compound then can be removed from the nozzle simply by pulling the tool away from the nozzle.

According to yet another embodiment of the invention, a device for removing dried caulking compound from a caulking tube nozzle includes a caulk dispenser having a receptacle with opposing end walls for supporting a caulking tube cartridge and a drive screw for displacing a pressure plate which engages a plunger of the cartridge to dispense caulking compound from the cartridge. An elongate member has a first end portion attached to the dispenser and a second, opposite end having a generally threaded or coiled portion. The threaded or coiled portion can be used to engage and remove dried caulking compound from the caulking tube nozzle prior to re-use, as well as to pierce through a foil backing when using a new cartridge.

The present invention provides an effective and easy-to-use device for cleaning dried caulking compound from the nozzle of a caulking tube. By freeing caulking compound and debris from the nozzle, the risk of caulk tube "blow-out" is reduced or avoided. The present invention also reduces waste of caulking compound by avoiding the need or tendency to discard caulking tubes prematurely because of the aforementioned difficulties associated with re-use. The present invention also avoids the need for cutting off a portion of the tip of the nozzle which has been obstructed by dried caulking compound, thereby permitting re-use of caulking tubes without adversely affecting control of caulk flow.

DETAILED DESCRIPTION OF THE INVENTION

Figure 1:
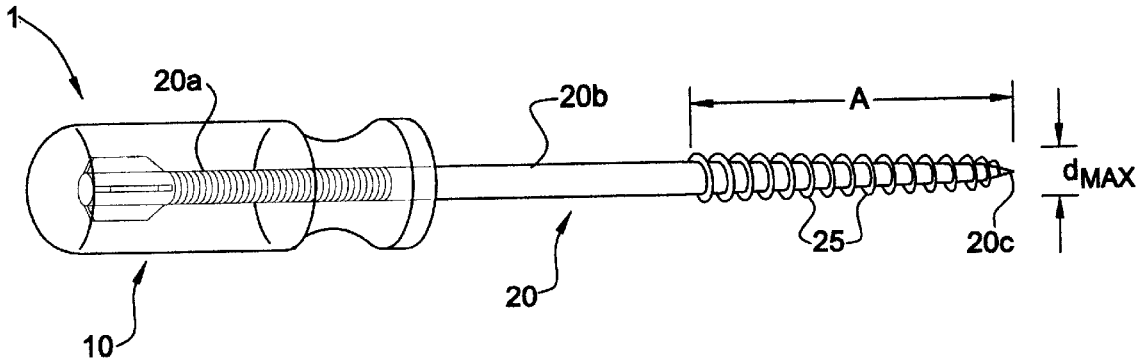
FIG. 1 is a perspective view of a device in accordance with one preferred embodiment of the invention.

With reference to FIG. 1, in accordance with a preferred embodiment of the invention, the device 1 includes a handle 10 and a unitary, generally cylindrical member 20 having a first end portion 20*a* attached to the handle 10, a middle portion 20*b*, and a second end 20*c* opposite to the handle 10. The generally cylindrical member 20 includes a threaded portion A extending from the second end 20*c* toward the middle portion 20*b*. The threaded portion A is adapted to threadably engage dried caulking compound disposed within a caulking tube nozzle when the handle 10 is rotated. The dried caulking compound then can be removed from the nozzle simply by pulling the tool 1 away from the nozzle. It may be desirable to remove the dried caulking compound from the nozzle in sections rather than all at once.

The handle 10 can be constructed from any conventional materials such as wood, plastic, or the like. The first end portion 20*a* of the generally cylindrical member 20 can be secured to the inner portion of the handle 10 in any suitable manner which resists slipping of the generally cylindrical member 20 when the handle 10 is rotated. The handle 10 and first end portion 20*a* of the generally cylindrical member 20 can be similar in style and construction to a conventional hand-held screwdriver. As will be appreciated by those skilled in the art, the size and shape of the handle 10, as well as the overall length of the device 1, should be suitably selected to facilitate the convenient use of the tool. In a preferred embodiment, the overall length of the device is 6 ½ inches.

Figure 8:
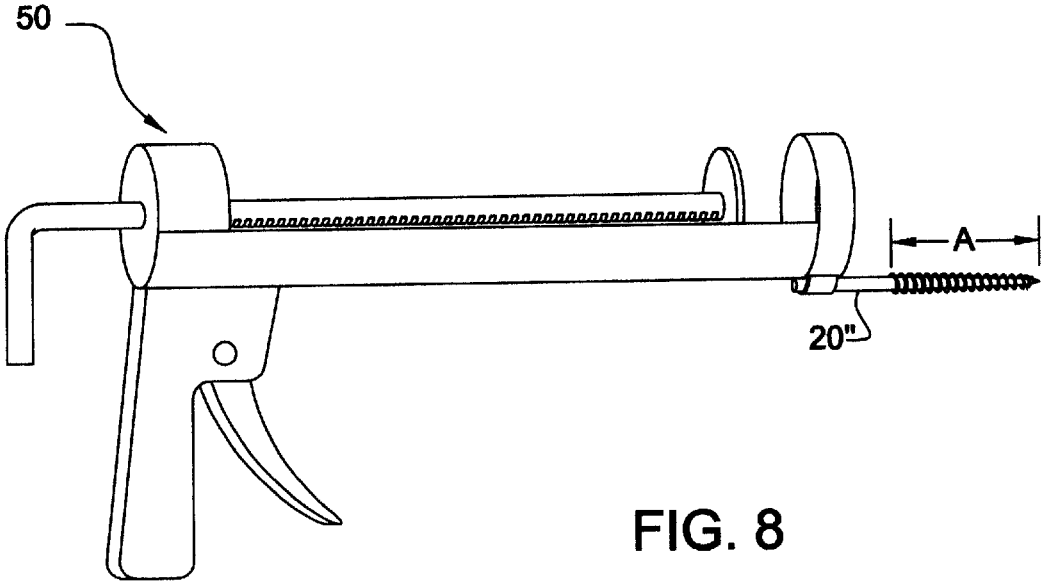
FIG. 8 is a perspective view of a caulk dispenser having a threaded caulk removal member in accordance with one embodiment of the present invention.

In another embodiment, as illustrated in FIG. 8, a generally cylindrical member 20" having a threaded end portion A can be attached in any suitable manner to the end of a caulk dispenser 50. The generally cylindrical member 20" can be pivotably attached to the end of the caulk dispenser. While in the extended position, the threaded portion A can engage and remove dried caulking compound from the caulking tube nozzle prior to re-use, as well as pierce through a foil backing when using a new cartridge.

The generally cylindrical member 20 can be constructed of metal (e.g., steel), plastic, or any other material which is sufficiently strong and sturdy to engage dried caulking compound and to remove the compound from a caulking tube nozzle. Preferably, the generally cylindrical member 20 is of unitary, solid construction to simplify the procedure of cleaning caulking compound from the threaded portion A between uses. In the embodiment described below with a coiled construction A', the dried caulking compound often gets lodged in the cavity between and within the coils 25' during use, which makes the cleaning of the tool 1' between uses more difficult than the cleaning of the tool 1 having the solid construction.

The threaded portion A should have a maximum diameter $d_{max}$ which permits its entry into and removal from the nozzle of a caulking tube without substantially irreversibly widening the tip of the nozzle. To facilitate most effectively the use of the device 1 with a wide variety of conventional caulking tubes, the threaded portion A preferably is tapered and preferably has a minimum diameter (i.e., at the second end 20*c*) which is from about 0.05 to about 0.2 inches, more preferably from about 0.1 to about 0.15 inches. Preferably, the threaded portion A has a maximum diameter (i. e, at that end which is proximate to the middle portion 20*b*) which is from about 0.2 to about 0.4 inches, more preferably from about 0.2 to about 0.3 inches. In one preferred embodiment, the minimum diameter is 0.125 inches and the maximum diameter is 0.25 inches.

Figure 3:
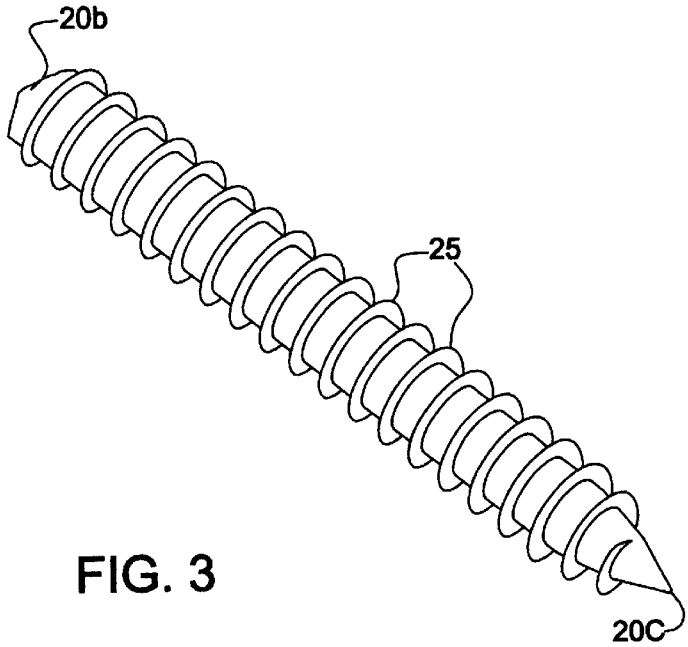
FIG. 3 is an enlarged view of a threaded metal end in accordance with one preferred embodiment of the invention.

As illustrated in FIGS. 1 and 3, the threaded portion A can have optionally tapered threads 25 somewhat resembling a large wood screw. The spacing and thickness of the threads 25 can be either constant or variable, and should be suitably selected to permit dried caulking compound to be threadably engaged and removed from the caulking tube nozzle. When using caulk materials that remain flexible when dry, e.g., siliconized latex, silicon caulk, certain construction adhesives that do not dry to the point of being brittle, etc., the threads 25 preferably are spaced evenly. In one preferred embodiment, the threads 25 are spaced evenly at intervals of 0.125 inches and have a thickness (gauge) of 0.0625 inches.

Figure 4:
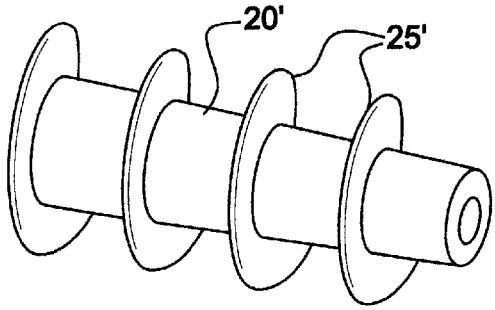
FIG. 4 is an enlarged view of a threaded plastic end in accordance with another preferred embodiment of the invention.
Figure 5:
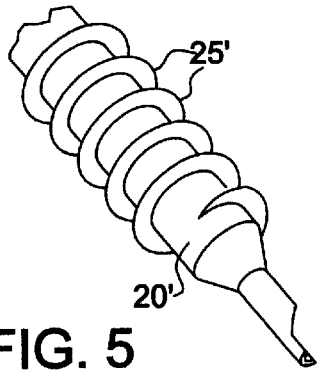
FIG. 5 is an enlarged view of a threaded plastic end in accordance with another preferred embodiment of the invention.

Many caulk materials include elastic additives, e.g., to allow for expansion and contraction after application. When using such elastic materials, it may be advantageous to use a threaded portion having fins 25' which are wide relative to a supporting shaft 20' (FIGS. 4–5) to engage the elastic material more effectively. As illustrated in FIG. 4, the fins 25' preferably increase in width (diameter) along the length of the shaft 20'. Preferably, the edges of the fins 25' are flared upward slightly to further prevent the caulk material from pulling away during removal from the nozzle.

The length of the threaded portion A preferably is selected to approximate the length of a typical caulking tube nozzle. Preferably, the length of the threaded portion A is from about 1 to about 3 inches, more preferably from about 2 to about 2.5 inches. In a preferred embodiment, the length of the threaded portion A is 2.5 inches.

Figure 2:
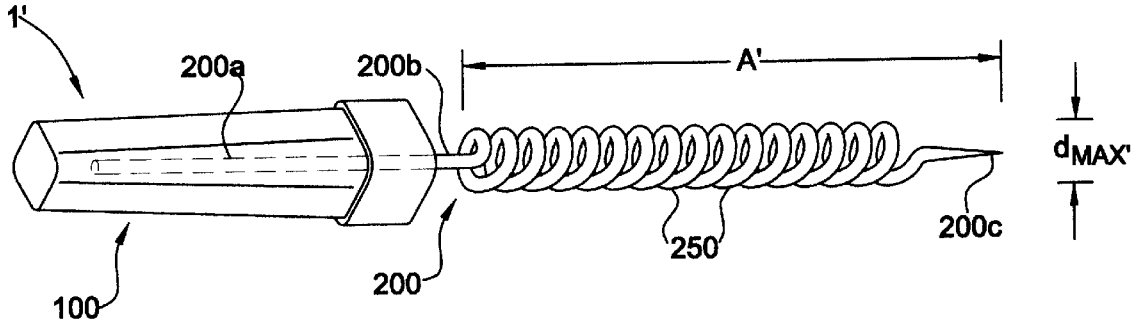
FIG. 2 is a perspective view of a device in accordance with an alternative embodiment of the invention.
Figure 6:
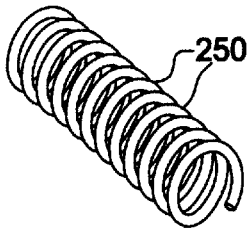
FIG. 6 is an enlarged view of a coiled end in accordance with an alternative embodiment of the invention.
Figure 7:
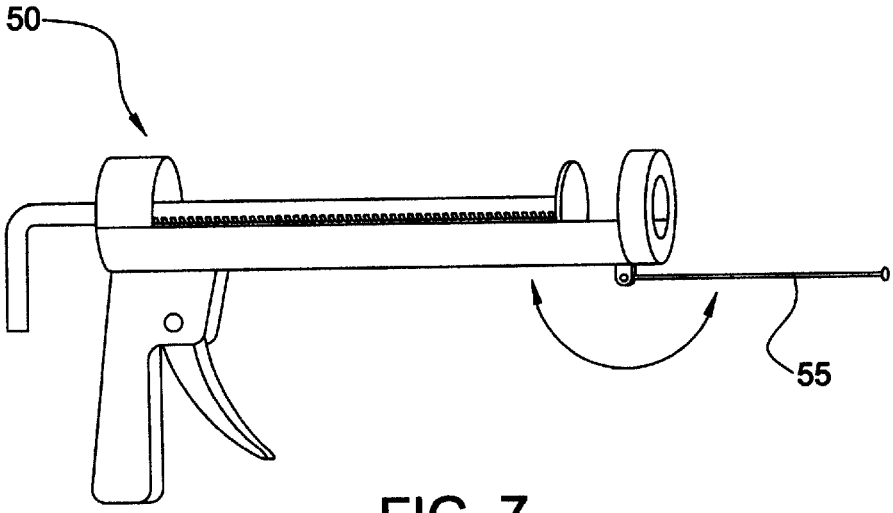
FIG. 7 illustrates a conventional caulk dispenser having a steel puncture probe.

With reference to FIGS. 2 and 6, in accordance with an alternative embodiment of the invention, a device 1' includes an elongate member 200 having a first end 200*a* attached to the handle 100 and a second end 200*c* opposite to the handle 100. The elongate member comprises a coiled portion A' extending from the second end 200*c* toward the handle 100. The device 1' functions in a similar manner as the device 1 of the first embodiment, e.g., the coils 250 engage dried caulking compound within a caulking tube nozzle by rotating the handle 100, and the dried caulking compound then is removed from the nozzle by pulling the tool 1' away from the nozzle.

The coiled portion A' should have a maximum diameter $d_{max}'$ which permits its entry into and removal from the nozzle of a caulking tube without substantially irreversibly widening the tip of the nozzle. Preferably, the coiled portion A' has a maximum diameter $d_{max}'$ of from about 0.2 to about 0.4 inches, more preferably from about 0.2 to about 0.3 inches, and even more preferably about 0.25 inches.

Figure 9:
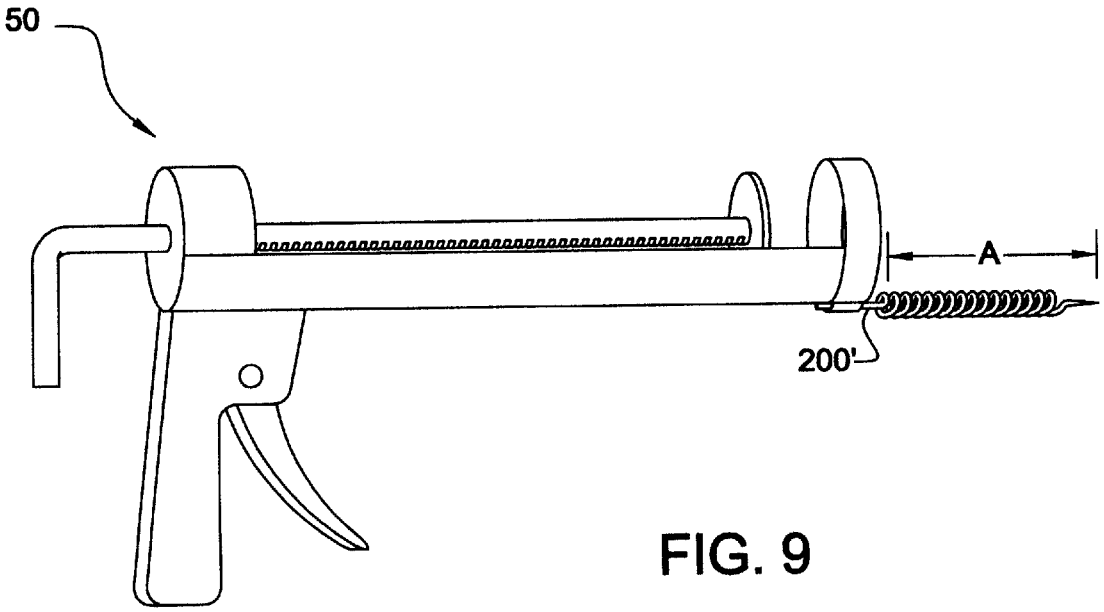
FIG. 9 is a perspective view of a caulk dispenser having a coiled caulk removal member in accordance with another embodiment of the present invention.

In another embodiment, as illustrated in FIG. 9, an elongate member 200' having a coiled end portion A' can be attached in any suitable manner to the end of a caulk dispenser 50. The elongate member 200' preferably is pivotably attached to the caulk dispenser. While in the extended position, the coiled portion 200' can engage and remove dried caulking compound from the caulking tube nozzle prior to re-use, as well as pierce through a foil backing when using a new cartridge.

The principles, preferred embodiments and modes of operation of the present invention have been described in the foregoing specification. The invention which is intended to be protected herein, however, is not to be construed as limited to the particular forms disclosed, since they are to be regarded as illustrative rather than restrictive. Variations and changes may be made by those skilled in the art without departing from the spirit of the invention.

I claim:

1. A device for removing dried caulking compound from a caulking tube nozzle, the device comprising:

a handle; and a generally cylindrical member having a first end portion attached to said handle, a middle portion, and a second end generally opposite to said handle;

wherein said generally cylindrical member comprises a generally threaded portion extending from said second end toward said middle portion;

wherein said generally threaded portion is adapted to threadably engage said dried caulking compound disposed within said nozzle when said handle is rotated and to remove said dried caulking compound when said handle is pulled away from said nozzle.

2. The device of claim 1 wherein said generally threaded portion extends about 1 to about 3 inches from said second end of said generally cylindrical member.

3. The device of claim 2 wherein said generally threaded portion extends about 2 to about 2.5 inches from said second end of said generally cylindrical member.

4. The device of claim 3 wherein said generally threaded portion is tapered and has a minimum diameter at said second end of said generally cylindrical member which is from about 0.05 to about 0.2 inches, and a maximum diameter which is from about 0.2 to about 0.4 inches.

5. The device of claim 4 wherein said minimum diameter is from about 0.1 to about 0.15 inches, and wherein said maximum diameter is from about 0.2 to about 0.3 inches.

6. In combination, the device of claim 1 and a caulking tube.

7. A device in combination with a caulking tube for removing dried caulking compound from a caulking tube nozzle, comprising;

a caulking tube and a device;

the device comprising:

a handle; and an elongate member having a first end portion attached to said handle and a second end generally opposite to said handle;

wherein said elongate member comprises a generally coiled portion extending from said second end toward said handle;

wherein said generally coiled portion has a maximum diameter of about 0.3 inches or less and is adapted to engage said dried caulking compound disposed within said nozzle when said handle is rotated and to remove said dried caulking compound when said handle is pulled away from said nozzle.

8. The device of claim 7 wherein said generally coiled portion extends about 1 to about 3 inches from said second end of said elongate member.

9. The device of claim 8 wherein said generally coiled portion extends about 2 to about 2.5 inches from said second end of said elongate member.

10. The device of claim 7 wherein said diameter is from about 0.2 to about 0.3 inches.

* * * * *